US006095028A

United States Patent [19]

Lämås et al.

[11] Patent Number: 6,095,028

[45] Date of Patent: Aug. 1, 2000

[54] HYDRAULIC UNIT

[75] Inventors: Axel Stig Lämås, Karlstad; Allan Sven Jonsson, Kil, both of Sweden

[73] Assignee: Kvaerner Pulping AB, Sweden

[21] Appl. No.: 09/091,078

[22] PCT Filed: Dec. 16, 1996

[86] PCT No.: PCT/SE96/01663

§ 371 Date: Jun. 9, 1998

§ 102(e) Date: Jun. 9, 1998

[87] PCT Pub. No.: WO97/24533

PCT Pub. Date: Jul. 10, 1997

[30] Foreign Application Priority Data

Dec. 29, 1995 [SE] Sweden ..... 9504695

[51] Int. Cl.[7] ..... F15B 1/24

[52] U.S. Cl. ..... 91/417 R; 91/437; 91/440; 91/464

[58] Field of Search ..... 91/394, 396, 437, 91/440, 464, 417 R, 47

[56] References Cited

U.S. PATENT DOCUMENTS

| | | | |
|---|---|---|---|
| 1,343,610 | 6/1920 | Bayles . | |
| 1,440,730 | 1/1923 | Gartin . | |
| 3,606,818 | 9/1971 | Hirn . | |
| 5,050,380 | 9/1991 | Jonsson | 60/413 |

*Primary Examiner*—Edward K. Look
*Assistant Examiner*—Thomas E. Lazo
*Attorney, Agent, or Firm*—Fasth Law Offices; Rolf Fasth

[57] ABSTRACT

The invention relates to a hydraulic unit for feeding an object at a desired feed speed a distance in a given feed direction during a working stroke and, in a return stroke, bringing the object back to the initial position at a considerably greater return speed, comprising a double-acting working cylinder (1) with a piston (16), the piston rod (17) of which is connected to the object which is to be moved, and a receiver cylinder (2) which is provided with a second piston (28) and designed to be filled with oil from the working cylinder during the return stroke, the first piston (16) and the second piston (28) being interconnected by a rigid connecting member (31) which forces the second piston to follow the movements of the first piston.

23 Claims, 1 Drawing Sheet

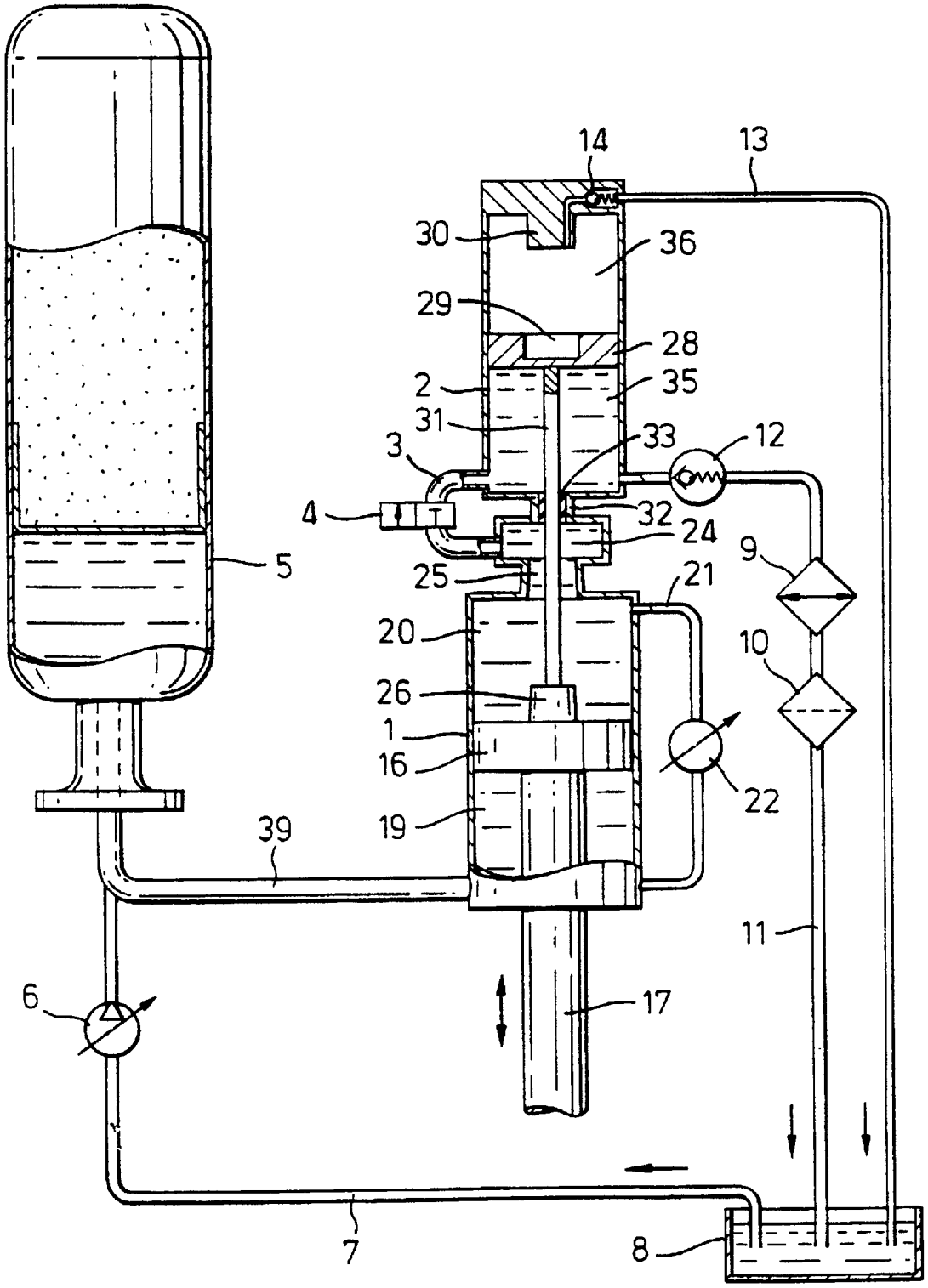
14
13
30
36
29
28
2
35
31
33
12
3
4
32
24
9
5
25
21
20
10
26
1
16
22
39
19
11
6
17
7
8

HYDRAULIC UNIT

TECHNICAL FIELD

The invention relates to a hydraulic unit for feeding an object at a desired feed speed a distance in a given feed direction during a working stroke and, in a return stroke, bringing the object back to the initial position at a considerably greater return speed, comprising a double-acting working cylinder with a first piston, the piston rod of which is connected to the object which is to be moved, and a receiver cylinder which is provided with a second piston and designed to be filled with oil from the working cylinder during the return stroke. The invention relates in particular to a hydraulic unit intended to move a screen unit forming part of a so-called diffuser, more specifically a pressure diffuser, for washing cellulose pulp, although the invention can very well also be used in atmospheric diffusers.

BACKGROUND OF THE INVENTION

In so-called pressure diffusers which in the cellulose industry are used for washing pulp in continuously working washing columns, the screen unit is reciprocated with the aid of a hydraulic working cylinder via a pull rod. The stroke length is normally up to approximately one meter. During the downward working stroke, the screen unit is fed slowly downwards at a speed which only slightly exceeds the sinking speed of the cellulose pulp in the column. On the other hand, the speed during the return stroke is high, normally approximately 1–1.5 m/s. The screen unit which is to be lifted during this rapid return movement can weigh more than ten tonnes and even larger installations have been planned. Furthermore, friction arises between the screen unit and the cellulose pulp in the column. The working cylinder and other parts in the hydraulic unit must therefore be of large dimensions in order to be capable of performing considerable work for a short time. This involves for example flow rates of the hydraulic oil of more than 10,000 l/min, oil quantities which furthermore have to filtered and cooled during the working cycle of the hydraulic unit. The systems which exist at present do not solve these problems in a satisfactory manner, which is hampering development within this field of technology towards increasingly large pressure diffusers and with this increasingly heavy screen units.

In order to meet the above requirements, the last fifteen years have seen the development of first the so-called float accumulator and then a hydraulic unit which comprises a so-called piston receiver. An advantage of the float accumulator is that it does not have dynamic gaskets which have to be replaced as a result of wear. In the case of greater oil quantities and cycle time, however, the gas losses become so great that gas refilling must take place frequently. The development of the piston receiver therefore constituted an improvement in this field. An example of a unit of this type is illustrated in SE 464533. Instead of gas charging, this unit has a hydraulic cylinder which presses the oil back to the tank. However, the principle has the disadvantage that the piston receiver must be completely, or at least essentially completely empty, before the next rapid return stroke is started. The emptying time must therefore be shorter than the shortest cycle time of the diffuser. This means that the hydraulic oil flow is highly discontinuous with a varying flow quantity. Apart from the fact that this involves difficulties in damping pressure peaks, the flow variation and the discontinuous manner of working also mean that filtering and cooling cannot take place optimally.

BRIEF DESCRIPTION OF THE INVENTION

The aim of the invention is to tackle the above problems and to provide an improved hydraulic unit. In particular, the aim of the invention is to solve problems in pressure diffusers in the cellulose industry but this does not preclude the possibility of the invention being applied in other fields of technology also where similar problems may arise. Further characteristics and aspects of the invention emerge from the description below of a preferred embodiment.

BRIEF DESCRIPTION OF THE FIGURES.

In the description below of a preferred embodiment, reference will be made to the FIGURES of the attached drawing, which illustrate diagrammatically the hydraulic unit (the hydraulic system) according to the preferred embodiment. The fact that the FIGURES of the drawing are diagrammatic means, inter alia, that it is not according to scale and that the various pipelines can be, and in several cases are, connected to the cylinders forming part of the unit in a different manner to that shown in the drawing, which is also stated in the description below.

DETAILED DESCRIPTION OF THE INVENTION

According to the embodiment, the hydraulic unit includes a working cylinder 1, a receiver cylinder 2, between the working cylinder 1 and the receiver cylinder 2 a connecting line 3 and a main valve 4 arranged therein, a high-pressure accumulator 5, a pump 6 in a line 7 between a hydraulic oil tank 8 and the high-pressure accumulator 5 together with a cooling arrangement 9 and a filter 10 for hydraulic oil in a return line 11 from the receiver cylinder 2 to the tank 8. In the return line 11, there is also a check valve 12 which allows flow only from the receiver cylinder 2 to the tank 8. A drain line 13 extends from the upper part of the receiver cylinder 2 to the tank 8. In this line 13, there is also a check valve 14.

The working cylinder 1 consists of a differential cylinder with a working piston 16 and a piston rod 17 which projects through the lower end of the working cylinder 1. According to the preferred application, the piston rod 17 is joined to a pull rod of a large screen unit forming part of a pressure diffuser for washing cellulose pulp in a continuously working column. For this purpose, the piston 16 and the piston rod 17 are to be capable of performing a slow, downward working stroke, conveying said screen unit, and, when a lower end position has been reached, rapidly performing a return stroke to the upper initial position. The stroke length is up to a meter according to the embodiment and the total length of the working cylinder 1 can consequently be slightly greater than a meter.

The piston 16 in the working cylinder 1 divides the working cylinder into a lower chamber 19 and an upper chamber 20. These can be interconnected by a line 21 which extends between ports close to or in the two end walls of the working cylinder 1. In the line 21, there is a shut-off and regulating valve 22.

The connecting line 3 between the working cylinder 1 and the receiver cylinder 2 extends between an intermediate chamber 24 and a port in the receiver cylinder 2 close to or in the lower end wall thereof. Between the upper chamber 20 of the working cylinder 1 and the intermediate chamber 24, there is a choke 25 designed to be capable of receiving a conical body 26 on the top side of the piston 16 in order to afford soft braking of the working piston 16 during its upward return stroke.

The receiver cylinder 2 has a smaller internal diameter than the working cylinder 1. A piston in the receiver cylinder—hereinafter called the displacement piston—has been designated 28. This has, in a manner known per se, a cylindrical recess 29 on the top side, the diameter of which matches a slightly longer male part 30 in the top of the cylinder. The drain line 13 extends as far as and opens into the lower surface of said male part 30.

According to the invention, a rigid connecting member in the form of a rod 31 extends between the working piston 16 in the working cylinder 1 and the displacement piston 28 in the receiver cylinder 2. The rod 31, the diameter of which is smaller than the piston rod 17 of the working piston, is firmly connected to the two pistons 16 and 28, which means that the movements of the working piston 16 are necessarily transmitted to the displacement piston 28 in the receiver cylinder 2 via the rod 31. Between the intermediate chamber 24, which in terms of function constitutes an integrated part of the working cylinder 1, and the receiver cylinder 2, there is a connecting piece 32 and, in this, a gasket 33 which bears sealingly against the rod 31 which can slide through said gasket 33.

According to a preferred embodiment, the ratio between the effective cross-sectional areas of the working cylinder 1 and the receiver cylinder 2 in the region of the chambers 20 and 35, i.e. deducting the area of the connecting rod 31, is approximately 5/4.

The displacement piston 28 divides the receiver cylinder 2 into a lower receiver chamber 35 for hydraulic oil and an upper waste-oil chamber 36.

In the high-pressure part of the unit, a connecting line 39 extends between the high-pressure accumulator 5 and the lower chamber 19 of the working cylinder 1, opening in a port in the lower end wall of the working cylinder 1. The connecting lines 3 and 39 are intended to be capable of transporting a large flow of oil under high pressure and are therefore of very large dimensions. According to the embodiment, they have an internal diameter for the intended application of 100–150 mm, preferably 130 mm. The return line 11, the connecting line 21 and the pump line 7 are to be capable of transporting oil at a lower flow rate and can therefore be made narrower. According to the embodiment for the intended application, they have an internal diameter of 50–80 mm. The drain line 13 is to be capable of only bringing waste oil back from the waste-oil chamber 16 to the tank 8 and can therefore be made very narrow.

The pump 6 contains means for sensing the pressure in the high-pressure part and for regulating the pump so that it constantly works to maintain a constant pressure in the high-pressure part, including the high-pressure accumulator 5. The pump 6 therefore works continuously in principle but with a flow which varies during the working cycle.

The method of working of the hydraulic unit (the hydraulic system) described above will now be explained. It is assumed that the working piston 16 and the displacement piston 28 are, at the beginning of a working cycle, situated in their upper end positions and that the conical body 26 is introduced into the choke 25. The downward working stroke of the working piston 16 and the piston rod 17 is initiated by the main valve 4 being shut (this position of the main valve is shown in the FIGURE) and the valve 22 being opened to a given position of adjustment which leads to a given choking in the connecting line 21. The pressure in the upper chamber 20 thus becomes virtually equal to that in the working chamber 19. But as the effective surface working on the working piston 16 is greater in the upper chamber 20 than in the lower chamber 19, the working piston 16 is pressed downwards. Its feed speed is determined by the adjustment of the valve 22. The receiver chamber 35 in the receiver cylinder 2 is filled with oil which is pressed out through the return line 11 via the check valve 12 with the aid of the displacement piston 28 which is pulled down by the working piston 16 via the connecting rod 31. In this position, the receiver cylinder 2 acts as a displacement pump. The oil is cooled in the cooling apparatus 9 and is filtered in the filter 10 before it is led to the tank 8. The pressure in the high-pressure part is regulated to the desired pressure with the aid of the pump 6. In this manner, the slower downward working stroke of the working piston 16 and the displacement piston 28 is continued until both pistons have reached their lower end positions.

When the working piston 16 and the displacement piston 28 have reached their lower end positions, the regulating valve 22 is shut and the main valve 4 is opened. The pressure in the upper chamber 20 in the working cylinder 1 thus falls so that the working piston 16, under the effect of the high pressure in the lower chamber 19 and in the pressure accumulator 5, is driven upwards rapidly and with great force. The pump unit 6 senses the fall in pressure and increases the flow of oil of the pump 6 from the tank 8 via the line 7 up into the high-pressure part, that is to say up into the high-pressure part. From the upper chamber 20 in the working cylinder 1, oil flows at a great flow rate up into the receiver chamber 35 via the choke 25, the intermediate chamber 24 and the connecting line 3. The displacement piston 28 is lifted upwards by the connecting rod 31 at the same speed as the working piston 16. As the receiver cylinder 2 has a smaller diameter than the working cylinder 1, however, the volume of the receiver chamber 35 does not increase at the same rate as the volume decreases in the chamber 20 in the working cylinder 1. Therefore, more oil is pressed through the connecting line 3 up into the receiver chamber 35 than it can receive. The surplus is pressed out through the return line 11 via the check valve 12 and the cooling apparatus 9 and the filter 10. This means that oil is led out of the receiver chamber 35 during both the downward working stroke, as has been described above, and the return stroke. This in turn means that the flow through the return line 11 and thus through the cooling apparatus 9 and the filter 10 is relatively uniform without great pressure peaks. This makes it possible for the cooling apparatus 9 and the filter 10 to be dimensioned and to work optimally.

Waste oil which goes past the displacement piston 28 is collected afterwards in the recess 29 and is pressed out through the drain line 13 to the tank 8 when the displacement piston 28 reaches its upper position. At the same time as this takes place, the conical part 26 on the working piston 16 is guided into the choke 25 which, in a manner known per se, leads to a braking of the working piston 16.

When the working piston 16 has thus reached its upper end position, that is to say returned to its initial position, the main valve 4 is shut again and the regulating valve 22 is opened, whereby a working cycle has been completed and a new cycle can be started. In this manner, the hydraulic unit works cyclically, the downward feed speed of the working piston 16 being regulated by adjustment of the valve 22 in accordance with the wishes which are determined by the conditions in the diffuser (not shown) which is connected to the piston rod and which, according to the application in question, is intended to be operated with the aid of the hydraulic unit.

It is to be understood that the invention is not limited to the embodiment described. For example, the drain chamber 36 can be connected to the surrounding atmosphere or be entirely open. It is also to be understood that the use of the invention is not limited to heavy hydraulics and very large flows of hydraulic medium. For example, the invention can very well also be used for small dimensions of components which are included and for flows where the speed or the hydraulic flow in any direction is so high that some kind of accumulator is convenient to use in a return line to the tank.

While the present invention has been described in accordance with preferred compositions and embodiments, it is to be understood that certain substitutions and alterations may be made thereto without departing from the spirit and scope of the following claims.

We claim:

1. A hydraulic cylinder for shifting an object a distance at a desired speed in a feed direction, comprising:

a first cylinder having a movable first piston disposed therein, the first piston being movable in a working stroke from a start position to an end position at a first speed and movable in a return stroke from the end position to the start position at a second speed, the second speed being substantially greater than the first speed;

a piston rod attached to the first piston;

a second cylinder having a movable second piston disposed therein, the second cylinder being adapted to be filled with a fluid from the first cylinder during the return stroke; and a rigid connecting member attached to both the first piston and the second piston so that the second piston is forced to follow any shifting of the first piston.

2. A hydraulic unit according to claim 1 wherein the second cylinder defines a second lower chamber below the second piston and the first cylinder defines a first upper chamber above the first piston and the hydraulic unit further comprises a connecting conduit that connects the second lower chamber with the first upper chamber and a main valve is disposed in the connecting conduit.

3. A hydraulic unit according to claim 2 wherein the first cylinder has a first cross sectional area in the first upper chamber and the second cylinder has a second cross-sectional area in the second lower chamber, a ratio between the first cross-sectional area and the second cross-sectional area is between about 1.1 and about 2.0.

4. A hydraulic unit according to claim 3 wherein the ratio is between about 1.1 and about 1.5.

5. A hydraulic unit according to claim 3 wherein the ratio is about 1.25.

6. A hydraulic unit according to claim 1 wherein the second cylinder has a second cross-sectional area and the first cylinder has a first cross-sectional area, the first cross-sectional area is greater than the second cross-sectional area.

7. A hydraulic unit according to claim 5 wherein a return line is in fluid communication with the second cylinder for transporting a hydraulic fluid.

8. A hydraulic unit according to claim 7 wherein the return line has a cooling apparatus in operative engagement therewith for cooling the hydraulic fluid.

9. A hydraulic unit according to claim 7 wherein the return line has a filter arrangement in operative engagement therewith for filtering the hydraulic fluid.

10. A hydraulic unit according to claim 1 wherein the hydraulic unit further comprises a high-pressure accumulator that is in fluid communication with a first lower chamber defined in the first cylinder.

11. A hydraulic unit according to claim 10 wherein the hydraulic unit further comprises a pump that is in operative engagement with the high-pressure accumulator to maintain a pressure in the high-pressure accumulator.

12. A hydraulic unit according to claim 10 wherein the hydraulic unit further comprises a transfer line that connects the first upper chamber with the first lower chamber and an adjustment valve is disposed in the transfer line.

13. A hydraulic cylinder assembly, comprising:

a first cylinder having a movable first piston disposed therein, the first piston being movable from a start position to an end position at a first speed and movable from the end position to the start position at a second speed, the second speed being substantially greater than the first speed;

a second cylinder having a movable second piston disposed therein;

a first channel section extending between the first cylinder and the second cylinder;

a first passage member having one end attached to the first channel section and an opposite end attached to the second cylinder;

a main valve in operative engagement with the first passage member, the main valve being movable between an opened position to permit a fluid flow between the first channel section and the second cylinder and a closed position to prevent any fluid flow between the first channel section and the second cylinder;

a rigid connecting member attached to both the first piston and the second piston so that the second piston is forced to follow any movement of the first piston, the connecting member extending from the first cylinder through the first channel section and into the second cylinder; and a gasket member disposed in the first channel section to sealingly receive the connecting member.

14. The hydraulic cylinder assembly according to claim 13 wherein the hydraulic cylinder assembly further comprises a pressure tank in fluid communication with the first cylinder, a hydraulic tank in fluid communication with the pressure tank via a first conduit, the hydraulic tank is in fluid communication with a bottom portion of the second cylinder via a second conduit and in fluid communication with a top portion of the second cylinder via a third conduit.

15. A method for moving fluid from a first cylinder to a second cylinder, comprising:

providing a first cylinder having a movable first piston disposed therein, a second cylinder having a movable second piston disposed therein, a rigid connecting member attached to both the first piston and the second piston so that the second piston is forced to follow any shifting of the first piston, a transfer conduit extending from a lower portion to an upper portion of the first cylinder, an adjustment valve is in operative engagement with the transfer conduit, a return line extending from the second cylinder to a hydraulic tank, and a cooling apparatus and a filter mechanism in operative with the return line;

moving the first piston and the second piston downwardly from an upper position at a first speed;

adjusting the first speed of the downwardly moving first piston by modifying the adjustment valve;

the second piston pressing out a return fluid from the second cylinder into the return line;

cooling the return fluid in the return line;

filtering the return fluid in the return line; and conveying the return fluid from the return line into the hydraulic tank.

16. The method according to claim 15 wherein the method further comprises providing a pressure tank in operative engagement with the first cylinder via a connecting line, a tank conduit extending from the hydraulic tank to the pressure tank, a pump in operative engagement with the tank conduit and regulating a pressure in the pressure tank by modifying a pumping speed of the pump.

17. The method according to claim 16 wherein the method further comprises moving the first piston to a bottom portion of the first cylinder and the second piston to a bottom portion of the second cylinder and closing the adjustment valve.

18. The method according to claim 17 wherein the method further comprises providing a main valve that is in operative engagement with a first passage member that extends between a first channel section disposed between the first cylinder and the second cylinder, opening the main valve and moving the first and second piston back to an upper position at a second speed, the second speed is substantially greater than the first speed.

19. The method according to claim 18 wherein the method further comprises increasing the pumping speed of the pump to pump a fluid from the hydraulic tank to the pressure tank.

20. The method according to claim 19 wherein the method further comprises conveying a fluid disposed in first cylinder into the first channel section and into the first passage member and then into the second cylinder.

21. The method according to claim 20 wherein the method further comprises conveying a portion of the fluid disposed in the second cylinder to the hydraulic tank via the return line.

22. The method according to claim 21 wherein the method further comprises providing the second piston with a cavity, collecting waste fluid in the cavity, moving the second piston to an uppermost portion of the second cylinder and conducting the waste fluid to the hydraulic tank with a third conduit that extends between the uppermost portion of the second cylinder and the hydraulic tank.

23. The method according to claim 21 wherein the method further comprises closing the main valve and partially opening the adjustment valve.

* * * * *